US006368124B1

(12) United States Patent
Wang

(10) Patent No.: US 6,368,124 B1
(45) Date of Patent: Apr. 9, 2002

(54) CARD EDGE CONNECTOR WITH DAUGHTER BOARD RETAINER

(75) Inventor: Lanyi Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/994,431

(22) Filed: Nov. 26, 2001

(51) Int. Cl.[7] ..... H01R 13/62
(52) U.S. Cl. ..... 439/153; 439/155; 439/160
(58) Field of Search ..... 439/153, 155, 439/157, 160

(56) References Cited

U.S. PATENT DOCUMENTS 4,232,926 A * 11/1980 Inouye et al. ..... 439/157
5,443,394 A * 8/1995 Billman et al. ..... 439/155
5,468,156 A * 11/1995 Flinchbaugh et al. ..... 439/155

FOREIGN PATENT DOCUMENTS

GB 2 028 014 A * 2/1980 ..... 439/160

* cited by examiner

*Primary Examiner*—Tho D. Ta
(74) *Attorney, Agent, or Firm*—Wei Te Chung

(57) ABSTRACT

A card edge connector includes an insulative housing mounted on a mother board and defining a central slot for receiving a daughter board. Conductive contacts are retained in the housing for electrically engaging the daughter board. The contacts are soldered to the mother board for establishing electrical connection between the mother board and the daughter board. A relatively resilient retention arm extends from the housing and is deflectable from an initial position to a final position. The retention arm has an inner surface facing the circuit board and a latch projection extends from the inner surface for engaging a notch defined in the daughter board when the retention arm is in the initial position. The latch projection is disengaged from the notch of the daughter board when the retention arm is manually deflected to the final position. A relatively rigid stop arm extends from the housing and substantially opposes the resilient arm with a gap formed therebetween. The retention arm and the stop arm diverge with respect to each other, whereby the gap gradually increases in a direction away from the housing for allowing the deflection of the retention arm with respect to the stop arm. The stop arm limits the deflection of the retention arm and serves as a support of a user's finger in manually deflecting the retention arm.

13 Claims, 5 Drawing Sheets

CARD EDGE CONNECTOR WITH DAUGHTER BOARD RETAINER

BACKGROUND OF THE INVENTION

1. Field of the Invention

The present invention generally relates to a card edge connector, and in particular to a card edge connector comprising a daughter board retainer for securely retaining a daughter board therein.

2. The Related Arts

A card edge connector functions to connect a daughter board to a mother board. An example of the card edge connector is a connector for connecting an Accelerated Graphics Port (AGP) card to a computer mother board. A conventional card edge connector comprises an insulative housing defining an elongate central slot for receiving an edge of a daughter board. Two rows of holes are defined on opposite sides of the central slot for receiving and retaining conductive contacts which are allowed to engage conductive pads on the daughter board.

Such a structure, however, cannot securely retain a daughter board in position inside the card edge connector. Thus, an AGP connector is equipped with a retainer for securing the daughter board. FIG. 5 of the attached drawings shows a conventional AGP connector 10 mounted on a mother board 12. The connector 10 comprises an insulative housing 14 defining a central slot 16 for receiving a daughter board (not shown). Two rows of holes 18 are defined on opposite sides of the central slot 16 for receiving and retaining conductive contacts (not shown). A retainer 20 which is shown separate from the connector 10 in the drawing comprises a frame-like body 22 tightly fit over the housing 14. If desired, fastening means may be adapted to securely fix the retainer 20 to the housing 14 of the connector 10. A resilient, deflectable arm 24 extends from the body 22. A projection 26 is formed on the arm 24 for engaging with a notch defined in the daughter board thereby securing the daughter to the connector 10.

The resiliency of the arm 24 allows a user to selectively engage/disengage the projection 26 with/from the notch of the daughter board. To provide sufficient resiliency for easy deflection by the user, the arm 24 must have a substantial length. Both the separate retainer and the long arm occupy a great amount of space which is adverse to the trend of miniaturization of electronic industry.

Furthermore, the deflectable arm 24 is usually operated by the fingers of the user. The user applies a force to deflect the arm 24 by his or her fingers and the reaction induced by the deflection is taken by the body 22 that is fixed to the housing 14 of the connector 10. Such a reaction may cause undesired damage to the connector 10 and even the mother board to which the connector 10 is mounted.

It is thus desirable to provide a card edge connector for alleviating the above mentioned problems.

SUMMARY OF THE INVENTION

Accordingly, an object of the present invention is to provide a card edge connector comprising a retention arm integrally extending from a housing of the connector.

Another object of the present invention is to provide a card edge connector comprising a deflectable retention arm forming a projection for selectively engaging a notch of a daughter board by the deflection thereof and a relatively rigid stop arm for limiting the deflection of the retention arm thereby eliminating the risk of damage caused on the housing and the retention arm itself.

Another object of the present invention is to provide a card edge connector comprising a deflectable retention arm having a projection for selectively engaging a notch of a daughter board by being deflected by a user's finger and a support member for supporting another finger of the user thereby eliminating reaction acting upon the connector.

To achieve the above objects, a card edge connector in accordance with the present invention comprises an insulative housing mounted on a mother board and defining a central slot for receiving a daughter board. Conductive contacts are retained in the housing for electrically engaging the daughter board. The contacts are soldered to the mother board for establishing electrical connection between the mother board and the daughter board. A relatively resilient retention arm extends from the housing and is deflectable from an initial position to a final position. The retention arm has an inner surface facing the circuit board and a latch projection extends from the inner surface for engaging a notch defined in the daughter board when the retention arm is in the initial position. The latch projection is disengaged from the notch of the daughter board when the retention arm is manually deflected to the final position. A relatively rigid stop arm extends from the housing and substantially opposes the resilient arm with a gap formed therebetween. The retention arm and the stop arm diverge with respect to each other, whereby the gap gradually increases in a direction away from the housing for allowing the deflection of the retention arm with respect to the stop arm. The stop arm limits the deflection of the retention arm and serves as a support of a user's finger in manually deflecting the retention arm.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
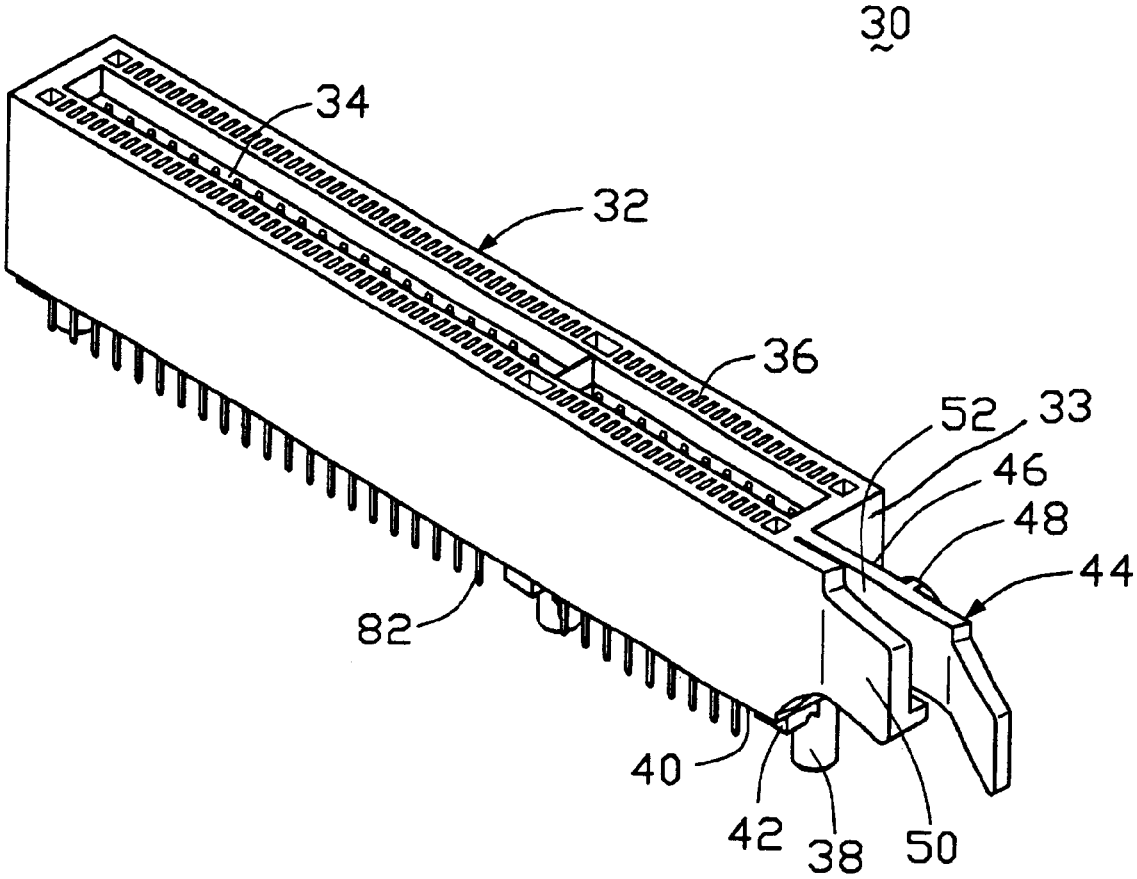
FIG. 1 is a perspective view of a card edge connector constructed in accordance with the present invention.
Figure 2:
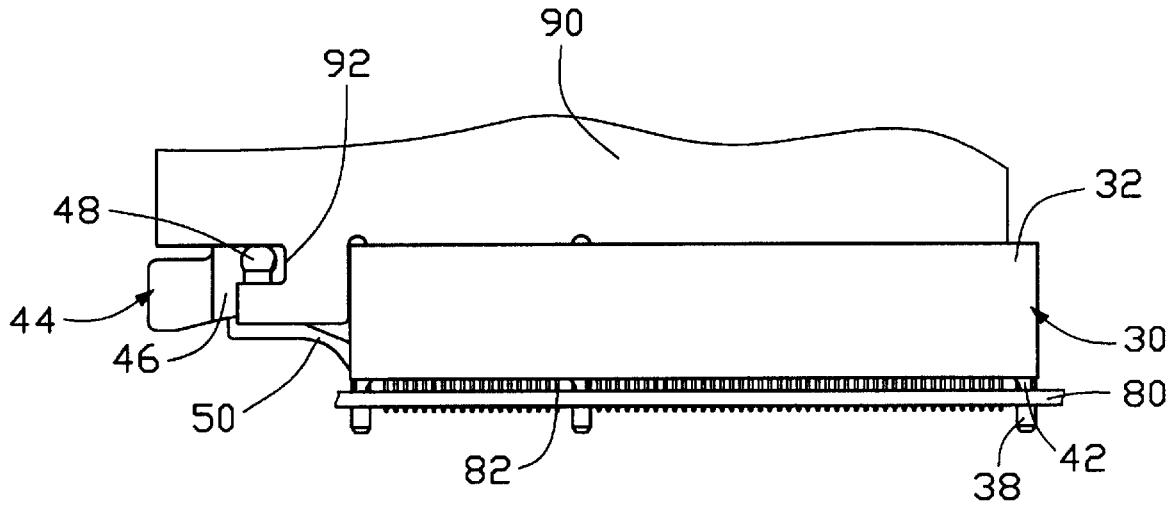
FIG. 2 is a side elevational view of the card edge connector of the present invention.

With reference to the drawings and in particular to FIG. 1, a card edge connector constructed in accordance with the present invention, generally designated with reference numeral 30, comprises an elongate housing 32 mounted to a mother board 80 (see FIG. 2). The housing 32 is made of an insulative material with an elongate slot 34 defined therein and substantially co-extensive therewith for receiving a daughter board 90 (see FIGS. 2 and 3). Two rows of holes 36 are defined in the housing 32 on opposite sides of the slot 34 for receiving and retaining conductive contacts 82 electrically engageable with the daughter board 90.

Also referring to FIG. 2, a plurality of positioning pins 38 extends from a bottom face 40 of the housing 32 for engaging with corresponding holes (not shown) defined in the motherboard 80. Standoffs 42 are formed the bottom face 40 of the housing 32 for suitably separating the housing 32 from the mother board 80.

Figure 3:
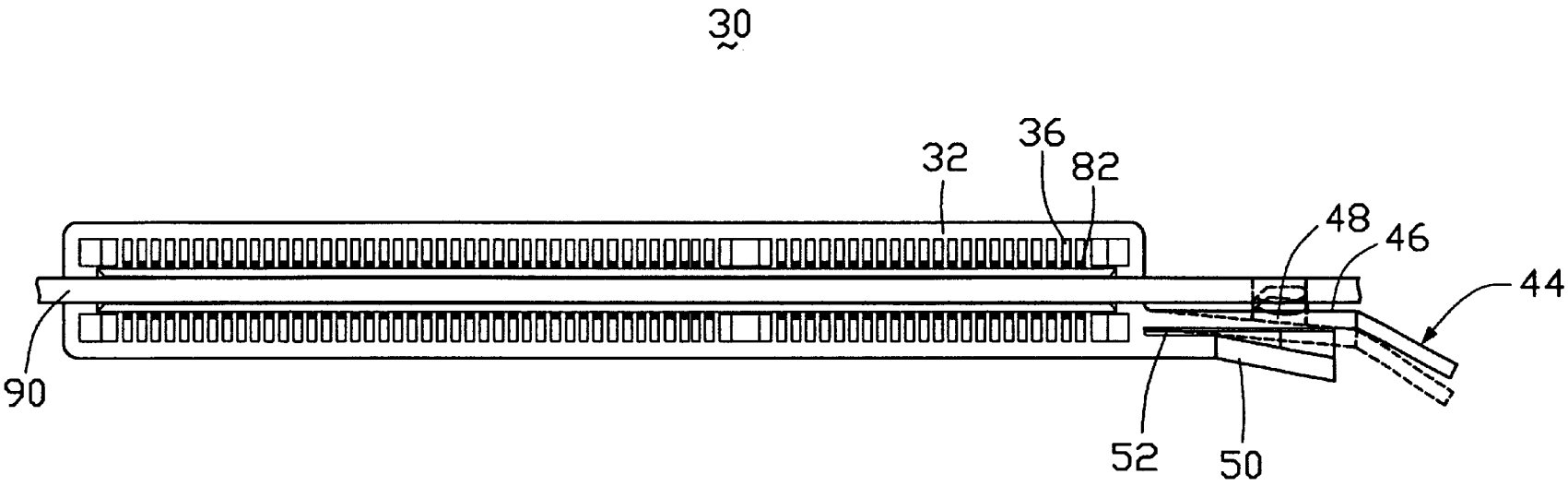
FIG. 3 is top plan view of the card edge connector of the present invention.

Also referring to FIG. 3, a relatively resilient retention arm 44 extends from an end (i.e., the end wall 33) of the housing 32 in a lengthwise direction of the housing 32. Preferably, the retention arm 44 is integrally formed with the housing 32. The retention arm 44 has an inner surface 46 facing the daughter board 90. A latch projection 48 is formed on the retention arm 44 and extending from the inner surface 46 for selectively engaging with a notch 92 defined in the daughter board 90. The resiliency of the retention arm 44 allows the retention arm 44 to be manually forced from an initial, non-deflected position (solid lines of FIG. 3) to a deflected position (phantom lines of FIG. 3). In the non-deflected position, the latch projection 48 engages the notch 92 of the daughter board 90 thereby securing the daughter board 90 in position inside the connector 30. In the deflected position, the latch projection 48 is disengaged from the notch 92 of the daughter board 90 thereby allowing detachment of the daughter board 90 from the connector 30.

A relatively rigid stop arm 50 also extends from the end of the housing 32 substantially opposing the retention arm 44 with a gap 52 formed therebetween. To allow the retention arm 44 to be manually forced to the deflected position, the gap 52 is gradually increased in a direction away from the housing 32 of the connector 30 (as is most clearly seen in FIG. 3). In other words, the stop arm 50 and the retention arm 44 diverge with respect to each other.

The stop arm 50 serves to limit the deflection of the retention arm 44 in order to avoid excessive stress or strain occurring in the retention arm 44 and the housing 32. In other words, the stop arm 50 defines the deflected position of the retention arm 44. The stop arm 50 also serves as a support for a user's finger (not shown) in manually deflecting the retention arm 44. Reaction force acting upon the housing of the connector caused by the deflection of the retention arm 44 as commonly observed in the conventional Accelerated Graphics Port (AGP) connector is thus substantially eliminated.

Figure 4:
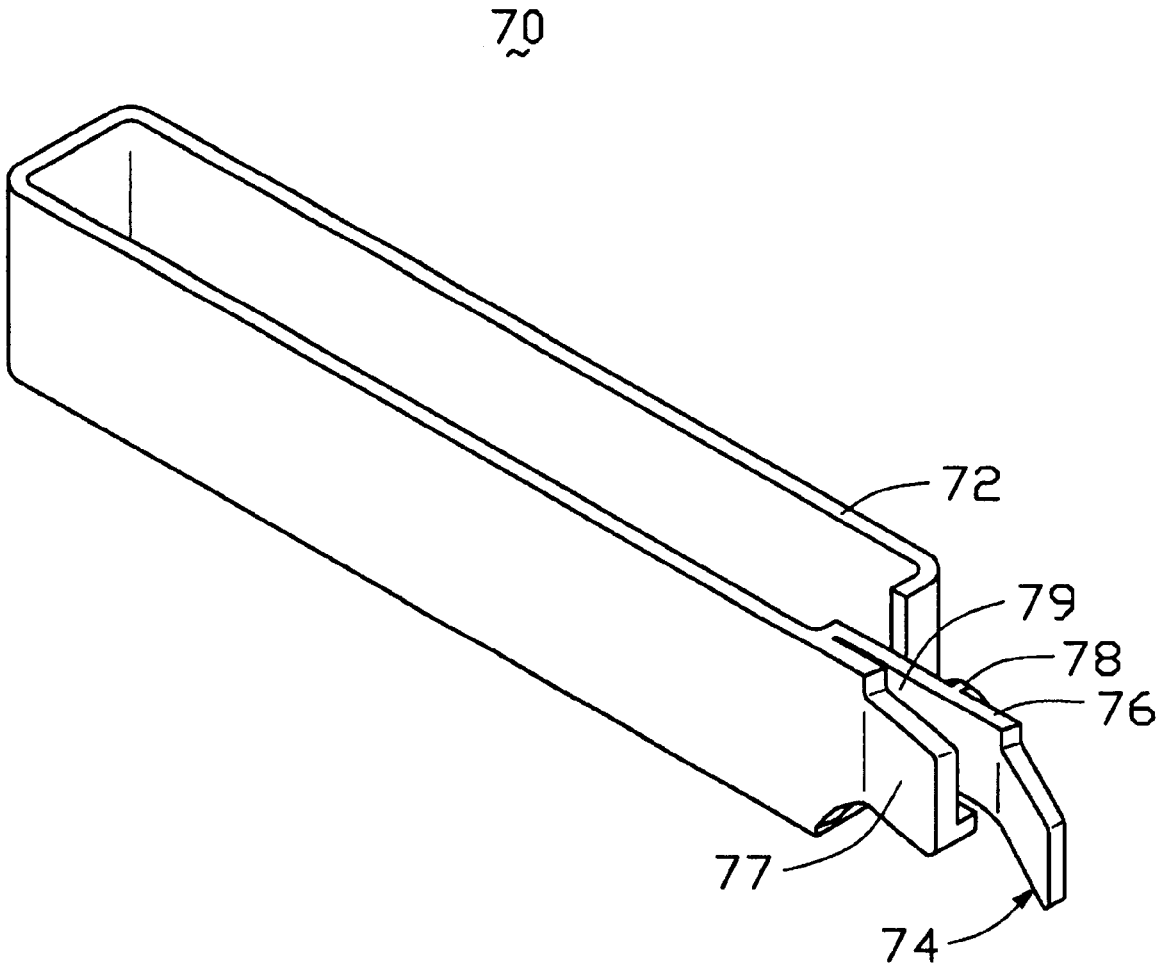
FIG. 4 shows a second embodiment of the present invention wherein a retainer is separately made for being mounted to a conventional card edge connector.
Figure 5:
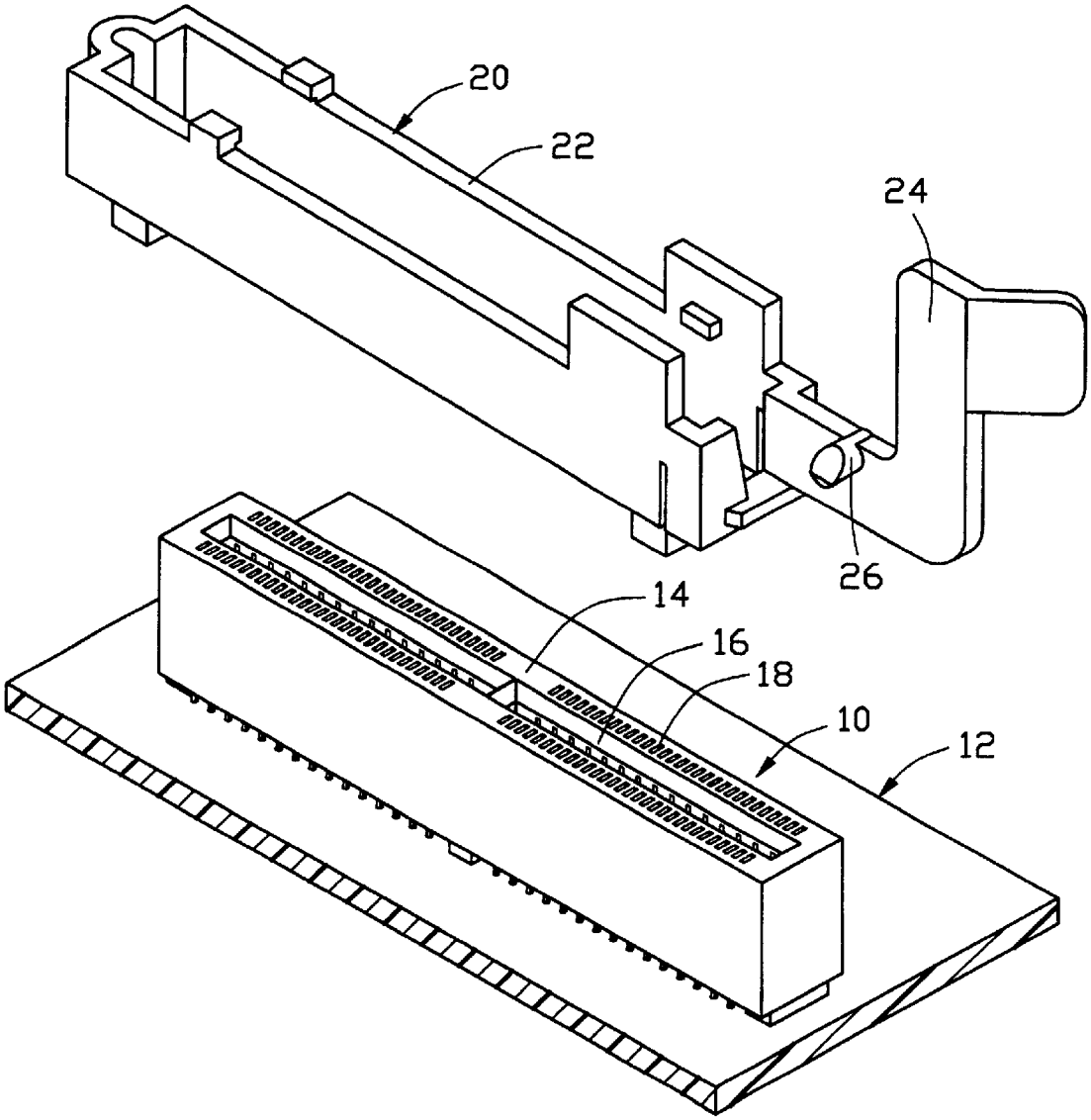
FIG. 5 (PRIOR ART)
FIG. 5 is a perspective view showing a conventional card edge connector mounted on a circuit board and a retainer to be mounted to the connector.

The relatively rigid stop arm can also be incorporated in a retainer of a conventional AGP connector. FIG. 4 shows a retainer constructed in accordance with the present invention, generally designated with reference number 70. The retainer 70 comprises a frame-like body 72 for being fit over an electrical connector, such as an AGP connector, mounted on a mother board (both not shown but similar to those shown in FIG. 5). A relatively resilient retention arm 74 extends from an end of the frame 72. The retention arm 74 has an inner surface 76 facing a daughter board (not shown) received in the AGP connector and a latch projection 78 extends from the inner surface 76 for engaging a notch or hole defined in the daughter board. A relatively rigid stop arm 77 extends from the frame 72 and substantially opposes the retention arm 74 with a gap 79 formed therebetween. The gap 79 can be made gradually increased in a direction away from the frame 72 for allowing the retention arm 74 to be manually deflected from an initial position where the latch projection 78 engaging the notch of the daughter board to a final position where the latch projection disengages from the notch of the daughter board.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An electrical connector comprising:

an insulative housing defining a slot adapted to receive a circuit board; conductive contacts retained in the housing for being electrically engageable with the circuit board;

a relatively resilient retention arm extending from the housing and being deflectable from an initial position to a final position, the retention arm having an inner surface adapted to face the circuit board, a latch projection extending from the inner surface for engaging a notch of the circuit board when the retention arm is in the initial position;

a relatively rigid stop arm extending from the housing and substantially opposing the resilient arm, a gap being formed between the retention arm and the stop arm for allowing the deflection of the retention arm, said stop arm serves to limit the deflection of said retention arm; and wherein said retention arm and said stop arm are integrally formed with said housing as a one-piece construction.

2. The electrical connector as claimed in claim 1, wherein the retention arm and the stop arm diverge with respect to each other whereby the gap is increased in a direction away from the housing.

3. The electrical connector as claimed in claim 1, which is adapted to be mounted to a circuit board and wherein the housing has a bottom surface from which positioning pins extend for engaging holes defined in the circuit board to which the connector is mounted.

4. The electrical connector as claimed in claim 3, wherein standoffs are formed on the bottom surface of the housing for separating the housing from the circuit board to which the connector is mounted a predetermined distance.

5. A retainer adapted to be mounted to an electrical connector for securing a circuit board in the electrical connector, the retainer comprising:

a frame adapted to fit over the connector;

a relatively resilient retention arm extending from the frame and being deflectable from an initial position to a final position, the retention arm having an inner surface adapted to face the circuit board, a latch projection extending from the inner surface for engaging a notch of the circuit board when the retention arm is in the initial position; and a relatively rigid stop arm extending from the frame and substantially opposing the resilient arm, a gap being formed between the retention arm and the stop arm for allowing the deflection of the retention arm, said stop arm serves to limit the deflection of said retention arm.

6. The retainer as claimed in claim 5, wherein the retention arm and the stop arm diverge with respect to each other whereby the gap is increased in a direction away from the housing.

7. An electrical connection system for connecting a daughter board to a mother board, the electrical connection system comprising:

a connector comprising:

an insulative housing adapted to be mounted to the mother board, the housing defining a slot adapted to receive the daughter board, and conductive contacts retained in the housing for being electrically engageable with the daughter board; and a retainer comprising:

a frame fit over the housing of the connector, a relatively resilient retention arm extending from the frame and being deflectable from an initial position to a final position, the retention arm having an inner surface adapted to face the circuit board, a latch projection extending from the inner surface for engaging a notch of the circuit board when the retention arm is in the initial position, and a relatively rigid stop arm extending from the frame and substantially opposing the resilient arm, a gap being formed between the retention arm and the stop arm for allowing the deflection of the retention arm, said stop arm serves to limit the deflection of said retention arm.

8. The electrical connection system as claimed in claim 7, wherein the retention arm and the stop arm diverge with respect to each other whereby the gap is increased in a direction away from the housing.

9. An electrical connector assembly comprising:

an insulative housing defining a central slot with a plurality of contacts by two sides thereof, said central slot defining a longitudinal direction thereof, a lateral direction being defined perpendicular to said longitudinal direction;

a resilient retention arm outwardly extending around one end of the housing along said longitudinal direction, said retention arm located in a position beside said central slot in said lateral direction;

a latching projection formed on the retention arm and extending toward the central slot in said lateral direction;

a stopper formed around the same end, said stopper being distant from said retention arm with a proper space opposite to said latching projection along said lateral direction; wherein the retention arm is deflectable generally along said lateral direction but is stopped by said stopper.

10. The assembly as claimed in claim 9, wherein said space is dimensioned to allow the latching projection to move laterally to be disengaged from a notch of a printed circuit board inserted into the central slot.

11. The assembly as claimed in claim 9, wherein said stopper extends obliquely in compliance with deflection of the retention arm.

12. The assembly as claimed in claim 9, wherein at least one of said retention arm and said stopper is integrally formed with said housing.

13. The assembly as claimed in claim 9, wherein said retention arm and said stopper is formed on a separate frame surrounding said housing.

* * * * *